US005984761A

United States Patent [19]

Kalinowski

[11] Patent Number: 5,984,761

[45] Date of Patent: Nov. 16, 1999

[54] TOY CLAPPER DEVICE AND METHOD OF MANUFACTURE

[76] Inventor: Raymond Kalinowski, 3260 Daske, Romeo, Mich. 48095

[21] Appl. No.: 09/079,773

[22] Filed: May 15, 1998

[51] Int. Cl.[6] ..... A63H 5/00

[52] U.S. Cl. ..... 446/421; 446/418; 84/402

[58] Field of Search ..... 446/397, 415, 446/418, 421, 422; 84/402, DIG. 21

[56] References Cited

U.S. PATENT DOCUMENTS

| | | | |
|---|---|---|---|
| D. 312,844 | 12/1990 | Jones . | |
| D. 318,695 | 7/1991 | Rosa . | |
| D. 369,388 | 4/1996 | Gilbert, Jr. et al. . | |
| D. 373,150 | 8/1996 | Zaksenberg . | |
| D. 391,308 | 2/1998 | Rapp . | |
| D. 392,000 | 3/1998 | Rapp . | |
| 1,711,309 | 4/1929 | Escovar | 84/402 |
| 3,019,553 | 2/1962 | Gomez et al. | 84/402 |
| 3,059,375 | 10/1962 | Tischer | 446/422 |
| 3,157,000 | 11/1964 | Stavig | 446/422 |
| 4,019,277 | 4/1977 | Kenkelen | 446/418 |
| 4,075,922 | 2/1978 | Smith | 84/402 |
| 4,227,326 | 10/1980 | Adler | 446/418 |
| 4,463,517 | 8/1984 | Kerr et al. . | |
| 4,810,228 | 3/1989 | Huggins . | |
| 4,976,651 | 12/1990 | Frank . | |
| 5,112,266 | 5/1992 | Hall . | |

*Primary Examiner*—Robert A. Hafer
*Assistant Examiner*—Jeffrey D. Carlson
*Attorney, Agent, or Firm*—Gifford, Krass, Groh, Sprinkle, Anderson & Citkowski, P.C.

[57] ABSTRACT

A toy clapper device having a main body including an elongate and planar shaped handle with first and second faces, a lower gripping end, an intermediate engaging portion, an upper portion and a central substantially circular shaped member also exhibiting first and second faces and extending integrally from the upper portion of the handle. First and second circular shaped paddles are dimensioned substantially identically to the central circular shaped portion, each of the paddles further including elongate planar shaped portions and seating portions extending from the planar shaped portions. The seating portions are received within the intermediate engaging portions along the first and second faces of the handle and are secured in place by a three dimensional and rectangular shaped collar portion with a central rectangular cavity which is slidably engaged over the lower gripping end and secured over the intermediate engaging portions so as to thereby sandwich therebetween the seating portions of the first and second paddles. The connection between the seating portions and the planar shaped portions of the paddles is provided by flexible hinges which permit the paddles to rhythmically engage the first and second faces of the central circular shaped member in a noise producing fashion.

6 Claims, 2 Drawing Sheets

TOY CLAPPER DEVICE AND METHOD OF MANUFACTURE

BACKGROUND OF THE INVENTION

1. Field of the Invention

The present invention relates generally to toy noisemaking devices and, more particularly, to an improved toy clapper device and method of manufacture which is an improvement over prior art noisemaker devices.

2. Description of the Prior Art

Noisemaker devices are well known in the art, the purposes for which include providing a child with a noise-producing novelty toy. Examples of such devices are illustrated in U.S. Design Pat. No. 373,150, issued to Zaksenberg and U.S. Design Pat. No. 392,000, issued to Rapp, each of which illustrates a clapper novelty device with an elongate central member and first and second paddle members all in the shape of a hand. The opposing and interengaging surfaces of the central member and paddle members also include raised peripheral rims which provide a percussive sound effect to the device when it is oscillated back and forth.

The shortcomings however to the Zaksenberg and Rapp designs include its inability to provide a sufficient amount of sound from clapping of the paddle portions against the central portion, this being largely due to the ornate "hand" design of the portions. A further shortcoming results from the placement of the clapper members so close to the pivot point defined by the engagement of the paddles to the central member. A further shortcoming results from the reduction on planar surface area of the outwardly facing surfaces of the paddles, this being otherwise desirable for the placement of written or pictorial indicia thereon.

A further example of a noisemaker device is illustrated by U.S. Pat. No. 4,463,517, issued to Kerr et al., which teaches a central body portion and a separate elongate member providing a pair of paddle portions each having a projection extending from an end thereof. The elongate member provided as the paddle portions is folded around the central body portion and the base is received within a separate handle portion. Similar to the Zaksenberg and Rapp designs, Kerr also suffers from the shortcoming of placement of the paddle portions and central portion too close to the pivot point defined by the engagement of the paddles to the central portion.

SUMMARY OF THE PRESENT INVENTION

The present invention is an improved toy clapper device having a main body constructed of a polymer material and including an elongate and planar shaped handle of a selected thickness and with first and second faces. The handle further includes a lower gripping end, a seating recess defining an intermediate engaging portion, an upper portion, and a central substantially circular shaped member also exhibiting first and second faces and extending integrally from the upper portion of the elongate handle.

First and second substantially circular shaped paddles are provided which are each substantially identical in dimension to the central circular shaped member. The paddles each further include a planar shaped portion and a seating portion maintaining pivotally associating engagement with the planar shaped portions by means of flexible hinges extending therebetween.

The seating portions of the paddles are received, respectively, into the seating recesses located on the first and second sides of the main body and a three dimensional and rectangular shaped collar portion having a central rectangular cavity is slidably engaged over the lower gripping end of the handle and secured over the intermediate engaging portions so that the seating portions are sandwiched therebetween.

The first and second paddles are secured to the first and second faces of the elongate handle a spaced distance from the pivot point defined by the length of the planar shaped portions extending from the paddles and so that the circular shaped paddles are registered in alignment with the faces of the central circular shaped member. The first and second faces of the elongate handle and the opposing engaging faces of the first and second paddles with planar shaped portions all include outwardly raised peripheral rims so that, upon engagement of the paddle portions with the central member resulting from oscillating motion being imparted to the clapper, a percussive sound effect is added to the noise produced.

Additional features of the clapper device include an eyelet recess formed through the first and second faces of the elongate handle proximate the gripping end as well as first and second pairs of projecting ribs extending in spaced apart fashion along a width of the first and second sides of the handle which establish the seating recesses therebetween. Also, the seating portions of the first and second paddles each further include a rectangular shaped element of predetermined length, width, and thickness which is capable of being received in a snap-fit fashion between the associated pairs of projecting ribs. The exterior facing surfaces of the paddles are further of such dimension to enable the placement of written or pictorial indicia thereon.

A toy clapper device is also disclosed which is capable of being produced by a process of manufacture, the process including the steps of establishing a die having four internal cavities corresponding to the main body of the clapper with elongate handle, the first and second paddles, and the three dimensional and rectangular shaped collar portion. Additional steps include the injection of a specified volume of a molten plastic at a specified pressure into the die so as to fill the four internal cavities, permitting the plastic to cool and solidify, and removing the main body, first and second paddles and collar from the die. Final assembly steps include assembling the first and second paddles onto the main body by engaging the seating portions into the recessed portions formed in the first and second sides of the elongate handle and slidably engaging the collar portion over a lower end of the elongate handle and securing over the recessed portions so as to thereby sandwich therebetween the seating portions of the first and second paddles.

BRIEF DESCRIPTION OF THE DRAWINGS

Reference will now be made to the attached drawings, when read in combination with the following specification, wherein like reference numerals refer to like parts throughout the several views, and in which.

DESCRIPTION OF THE PREFERRED EMBODIMENTS

Figure 1:
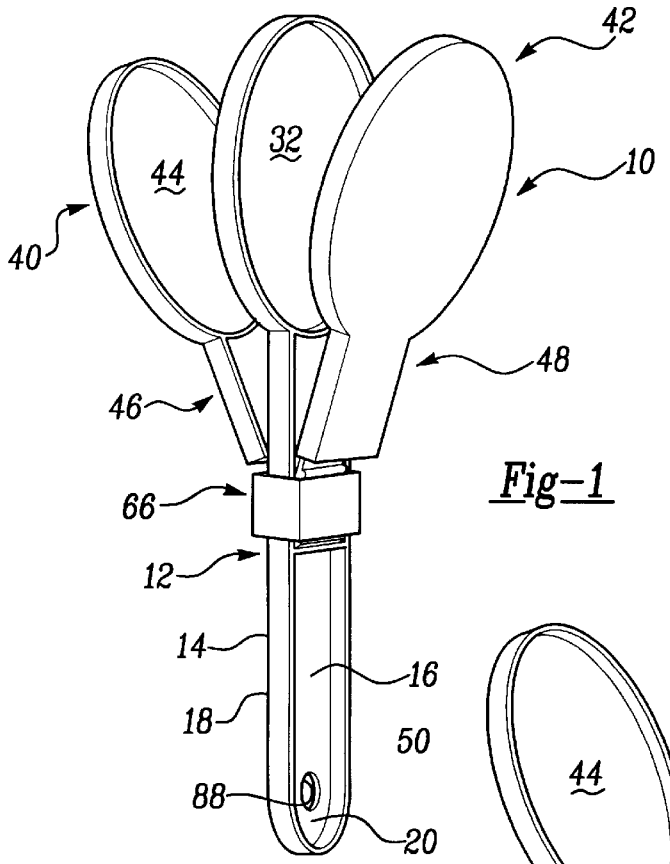
FIG. 1 is an environmental view of the toy clapper device according to the present invention.
Figure 2:
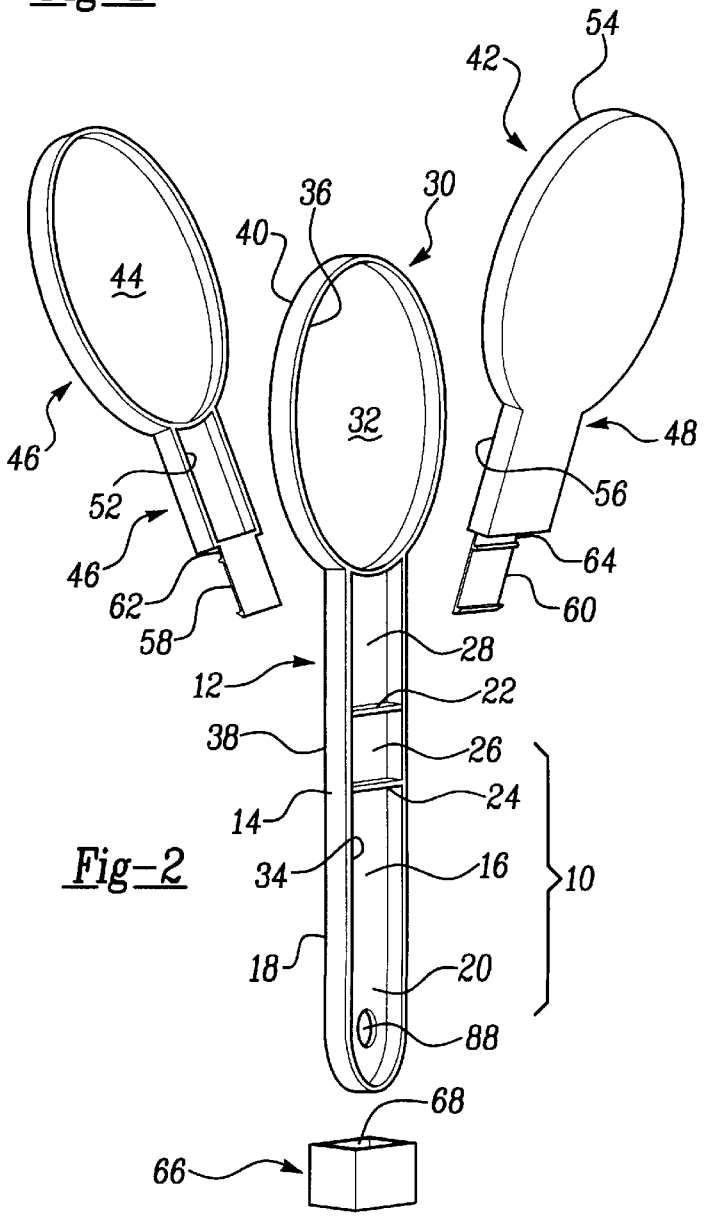
FIG. 2 is an exploded view of the toy clapper device illustrated in FIG. 1.
Figure 3:
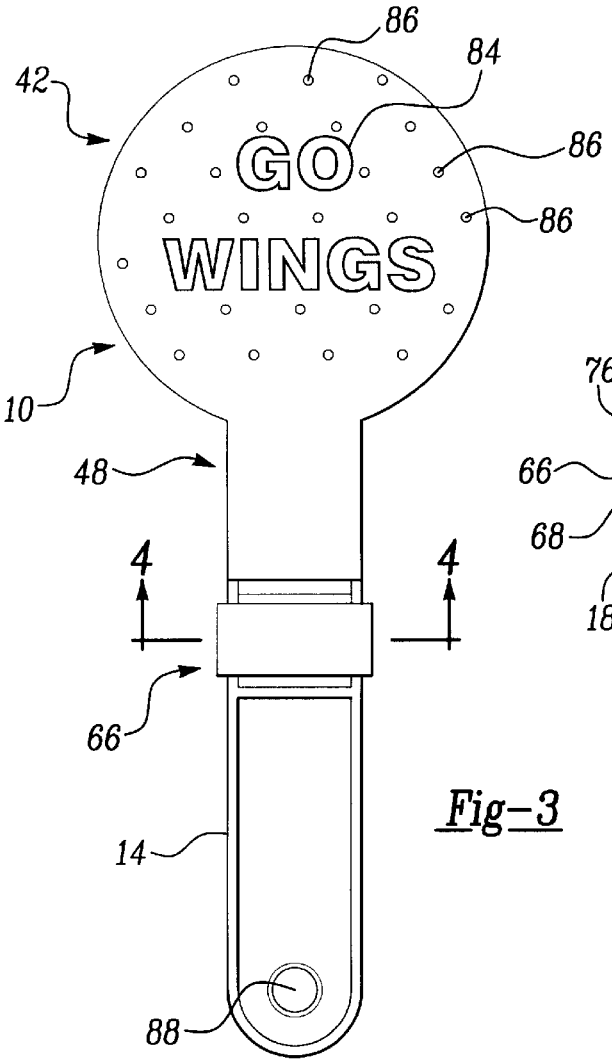
FIG. 3 is a frontal view of the toy clapper device according to the present invention.

Reference will now be made to FIGS. 1 and 2 which illustrate the toy clapper device 10 according to the preferred embodiment of the present invention. The device 10 includes a main body portion 12 preferably constructed of a polymer material and including an elongate and planar shaped handle 14 of a selected thickness and having a first face 16 and a second face 18 (which is largely hidden from view in FIGS. 1 and 2).

Each of the faces 16 and 18 (and specifically illustrating face 16) includes a lower gripping end 20, a pair of projecting ribs 22 and 24 which extend in spaced apart fashion the width of the planar face 16 at a selected location along the elongate handle 12 and which define therebetween a seating recess 26, an upper portion 28 and a central substantially circular shaped member 30 with an outwardly arrayed circular face 32 associated with the first face 16 of the main body 12. An outwardly raised and peripherally extending rim is provided around both the edges of the elongate handle, at 34, and the circular face 32, at 36. Although not clearly illustrated in FIGS. 1 and 2, it is understood that the hidden and reverse side of the main body 12 corresponding to face 18 includes the identical of each of the elements previously described at 20, 22, 24, 26, 28 and 32 according to the present invention and further illustrates peripherally extending rims at 38 for the elongate handle 12 and at 40 for the reverse face of the central circular shaped member 30.

A first paddle 40 and a second paddle 42 are illustrated and are arrayed opposite the first and second faces 16 and 18 of the main body 12. Each of the paddles 40 and 42 are likewise constructed of a polymer material and include an inwardly facing and substantially identically configured face in relation to the outwardly arrayed faces of the central substantially circular shaped member 30. Specifically, first paddle 40 includes an inwardly facing circular shaped face 44 and second paddle 42 includes a likewise inwardly facing circular shaped face which is hidden from view in FIGS. 1 and 2 however is identical to that shown at 44 for first paddle 40.

The first paddle 40 further includes a planar shaped portion 46 extending from the central circular portion and the second paddle 42 likewise includes a planar shaped portion 48 extending from the central circular portion. Additional peripheral rims are provided along the opposing and inwardly facing surfaces of the paddles 40 and 42 and are illustrated in FIGS. 1 and 2 by a first rim 50 extending peripherally around the inwardly facing circular shaped face 44 and by a second rim 52 extending peripherally around the planar shaped portion 46 of the first paddle 40, it once again being understood that identical rims 54 and 56 extend respectively from the inwardly facing circular face of the second paddle 42 and its planar shaped portion 48.

Each of the first and second paddles 40 and 42 further includes a rectangular shaped seating portion having a predetermined length, width and thickness and which are illustrated at 58 and 60, respectively. The seating portions 58 and 60 are maintained in pivotally associating engagement with the planar shaped portions 46 and 48 of the paddles 40 and 42 by means of flexible or living hinges extending therebetween at 62 and 64, respectively. The flexible hinges 62 and 64 are a type of webbed portion which permit the paddles to be pivoted relative to the seating portions 58 and 60 repeatedly without fatigue or material failure.

The seating portions 58 and 60 extending from the first and second paddles 40 and 42 are received in a snap-fit fashion between the pairs of projecting ribs (see ribs 22 and 24 of first face 16). A three-dimensional and rectangular shaped collar 66 is provided and which includes a central rectangular cavity defined by four opposing and inwardly facing walls of the collar 66. Referring to FIG. 4, the collar 66 is again illustrated in cross sectional cut-away and includes outwardly facing sides 68, 70, 72 and 74 and inwardly spaced sides 76, 78, 80 and 82 which define the central rectangular cavity.

The collar 66 is slidably engaged over the lower gripping end 20 of the elongate handle 14 (see again FIG. 2) and is translated upwardly along the handle until securing over intermediate engaging portions (or pairs of projecting ribs) so as to thereby sandwich therebetween the seating portions 58 and 60 of the first and second paddles 40 and 42. Upon securing of the annular collar 66 in place, the first and second paddles 40 and 42 are attached to the main body portion 12 so that the planar shaped portions 46 and 48 and outer rims 52 and 56 are in alignment with the upper portions and rims 34 and 38 of the main body. The inwardly facing surfaces of the circular shaped paddles with their peripheral rims 50 and 54 are also arranged in alignment with the central circular shaped member and peripheral rims 36 and 40. Upon engaging the gripping end 20 of the handle 14 in an oscillating fashion the first and second paddles 40 and 42 are caused to rhythmically engage the first and second faces of the central circular shaped member in a noise producing fashion. Also, by virtue of the percussive recesses formed by the opposing faces of the paddles and main body (again resulting from the peripheral rims) the sound made by the oscillating contact of the paddles against the central body is enhanced.

Figure 4:
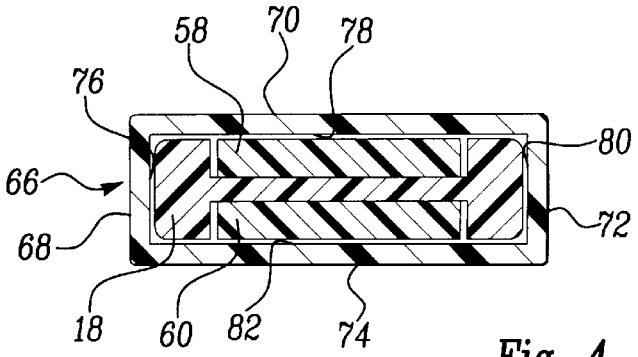
FIG. 4 is a cut-away taken along line 4—4 of FIG. 3 and illustrating in cross section the engagement of the seating portions of the paddle members within the seating recesses of the elongate handle and secured in place by the three dimensional rectangular collar according to the present invention.

Referring to FIG. 4, a front view of the clapper device 10 according to the invention is again shown and includes the placement of a writing indicia 84 (such as written or pictorial) upon one or both of the exterior facing surfaces of the first and second paddles 40 and 42. Due to the fairly significant level of sound produced by the rhythmic striking of the paddles 40 and 42 against the main body 12, it is sometimes desirable to decrease the sound produced by the clapper device 10 and this is accomplished by forming small pin holes 86 through the first and second paddles (illustrated in FIG. 4 as paddle 42). The purpose of the pin holes is to decrease by a selected audial volume the sound produced by the device 10 of the present invention. Also illustrated at 88 is an eyelet recess formed through the first and second faces 16 and 18 of the elongate handle 14, the eyelet 88 being useful for supporting a lanyard loop (not shown) or other suitable cord attachment for permitting the device to be worn about a user's neck such as at a sporting event.

Figure 5:
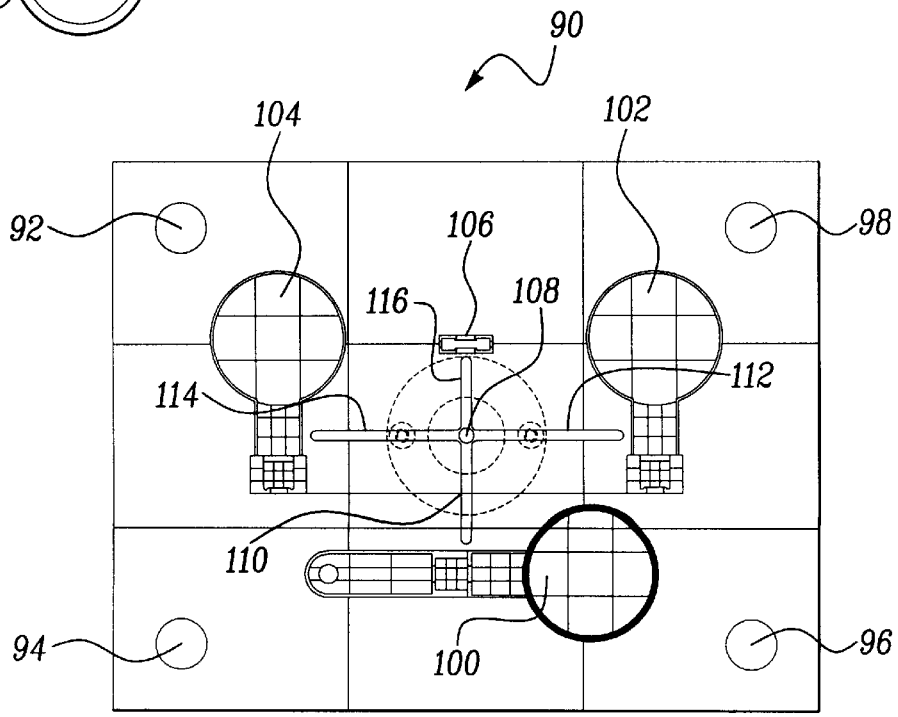
FIG. 5 is a plan view of a lower half of a die which is employed in producing the toy clapper by a process of manufacture according to the present invention.

Referring finally to FIG. 5, a die is shown at 90 for producing the toy clapper device 10 according to a process of manufacture of the present invention. For purposes of ease of illustration, die 90 is actually one half of a die, it being understood that an identical second half is provided to establish a closed mold for plastic injection molding of the toy clapper device.

The die 90 includes four seating apertures 92, 94, 96 and 98 for fixedly positioning the die 90 at a desired location within a conventional plastic injection molding machine (not shown). Four individual internal cavities are formed within the die 90 and include a first cavity 100 for the production of the main body 12, a second cavity 102 for the production of the first paddle 40, a third cavity 104 for the production of the second paddle 42 and, finally, a fourth cavity 106 for the production of the three dimensional collar 66. As is illustrated in FIG. 4, each of the cavities 100, 102, 104 and 106 corresponds in shape and dimension with the selected piece to be produced.

Process steps of the embodiment of FIG. 4 include setting up the die 90 within the associated injection molding machine and the injection of a specified volume of a molten plastic at a specified pressure into the die 90 so as to fill the first 100, second 102, third 104 and fourth 106 cavities. An initial channel 108 directs the molten plastic to a center of the die 90, where it is subsequently rerouted towards the first, second, third and fourth cavities by means of additional channels 110, 112, 114, and 116, respectively.

Once the injection molding step is completed, the molten plastic is permitted to cool and solidify. After sufficient set time, the main body, first and second paddles and collar portion are removed from their associated cavities within the die. Final steps involve the assembly of the four pieces into the clapper device and include assembling the first and second paddles onto the main body by engaging their seating portions into the recessed portions formed in the first and second faces of the elongate handle and slidably engaging the collar portion over a lower end of the elongate handle of the main body and securing over the handle recessed portions so as to thereby sandwich therebetween the seating portions of the first and second paddles.

Having described my invention, additional embodiments will become apparent to those skilled in the art to which it pertains without deviating from the scope of the appended claims.

I claim:

1. A toy clapper device, comprising:

a main body constructed of a polymer material and including an elongate and planar shaped handle of selected thickness and with first and second faces, each of said faces having a lower gripping end, a seating recess defining an intermediate engaging portion, and an upper portion, a central substantially circular shaped member also exhibiting first and second faces and extending integrally from said upper portion of said elongate handle;

a first substantially circular shaped paddle and a second substantially circular shaped paddle, each of said paddles likewise being constructed of a polymer material and each being dimensioned substantially identical to said central substantially circular shaped disk member, each of said paddles further including a planar shaped portion extending therefrom which is equal in dimension with said upper portion of said elongate and planar shaped handle;

said first and second paddles each further including a seating portion which is receivable within said seating recess of intermediate engaging portions of said first and second faces of said elongate handle, said seating portions maintaining pivotally associating engagement with said planar shaped portions of said first and second paddles by means of flexible hinges extending therebetween; and a three dimensional and rectangular shaped collar portion having a central rectangular cavity extending therethrough of sufficient dimension so as to permit said collar portion to be slidably engaged over said lower gripping end of said elongate handle and secured over said intermediate engaging portions so as to thereby sandwich therebetween said seating portions of said first and second paddles;

said first and second paddles secured to said first and second faces of said elongate handle so that said planar shaped portions are in alignment with said upper portion and said circular shaped paddles are in alignment with said faces of said central circular shaped member, said gripping end being engaged in an oscillating fashion to cause said first and second paddles to rhythmically engage said first and second faces of said central circular shaped member in a noise producing fashion.

2. The toy clapper as described in claim 1, said first and second faces of said elongate handle and said central circular shaped member further including an outwardly raised peripheral rim, said opposingly engaging faces of said first and second paddles with planar shaped portions each likewise including outwardly raised peripheral rims which align with said outwardly raised rims of said elongate handle and central circular shaped member upon rhythmic engagement of said paddles.

3. The toy clapper as described in claim 1, further comprising an eyelet recess formed through said first and second faces of said elongate handle proximate said gripping end.

4. The toy clapper as described in claim 1, said seating recess defining said intermediate engaging portion further comprising a first and second pairs of projecting ribs extending in spaced apart fashion along a width of said first and second sides of said elongate handle, said seating recesses being established between said pairs of projecting ribs.

5. The toy clapper as described in claim 4, said seating portions of said first and second paddles each further comprising a rectangular shaped element of predetermined length, width and thickness which is capable of being received in a snap-fit fashion between an associated said pair of projecting ribs.

6. The toy clapper as described in claim 1, further comprising a written or pictorial indicia capable of being placed upon exterior facing surfaces of said first and second paddles.

* * * * *